US009493019B2

(12) United States Patent
Kersey

(10) Patent No.: US 9,493,019 B2
(45) Date of Patent: Nov. 15, 2016

(54) PRINTING SYSTEM WITH OSCILLATING PAGEWIDE PRINTHEAD

(75) Inventor: Kevin T. Kersey, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 326 days.

(21) Appl. No.: 13/157,616

(22) Filed: Jun. 10, 2011

(65) Prior Publication Data

US 2012/0314003 A1 Dec. 13, 2012

(51) Int. Cl.
*B41J 2/165* (2006.01)
*B41J 25/00* (2006.01)

(52) U.S. Cl.
CPC ..... *B41J 25/001* (2013.01)

(58) Field of Classification Search
None
See application file for complete search history.

(56) References Cited

U.S. PATENT DOCUMENTS 4,349,828 A * 9/1982 Fischbeck et al. ..... 347/39
5,946,010 A * 8/1999 Isobe et al. ..... 347/37
6,183,063 B1 2/2001 Bolash et al.
6,767,073 B2 7/2004 Tschida
7,744,184 B2 6/2010 Carlson et al.
2007/0024661 A1 2/2007 Kim et al.
2007/0030300 A1 2/2007 Jeong
2007/0296757 A1* 12/2007 Mills et al. ..... 347/42
2009/0128599 A1 5/2009 Puigardeu et al.

OTHER PUBLICATIONS

Compaq Computer Corporation, Compaq User's Manual for "5525B/31/32 Line Matrix Printer User's Manual," P/N 422721-001, pp. 1-238, 1999.

* cited by examiner

*Primary Examiner* — Alejandro Valencia

(74) *Attorney, Agent, or Firm* — HP Inc. Patent Department

(57) ABSTRACT

An image printing device and method of printing may include an image medium advancing device to advance an image medium in a first direction, an oscillating printhead to oscillate or move along a second direction defined by an angle not normal to the first direction, and a plurality of ink nozzles associated with the printhead to apply ink to the image medium.

21 Claims, 5 Drawing Sheets

PRINTING SYSTEM WITH OSCILLATING PAGEWIDE PRINTHEAD

BACKGROUND

Printing devices may include various systems, methods, and/or devices to apply ink, toner, or other substances to an image medium (e.g., a sheet of paper). A printing device may, for example, apply ink to a sheet of paper using a printhead with multiple nozzles to eject ink onto the paper. Many printing devices may include traditional scanning printheads that scan back and forth over a sheet of paper while applying ink. Printing devices with scanning printheads may be inefficient for high speed printing because of the time it takes for the printhead to scan back and forth while printing a document and may require multiple passes over the same area on a sheet of paper to ensure acceptable image quality.

Some printing devices may include a fixed or semi-fixed page-wide array printhead to apply ink, toner, or other image creation substance to an image medium. A fixed page-wide array printhead may apply ink to a sheet of paper using multiple nozzles, and the printhead may include sufficient nozzles to statically span the width of a sheet of paper. A printing device may include a device to advance a sheet of paper under the printhead. Printing devices with fixed page-wide array printheads may be commonly used for high volume and/or high speed draft quality print jobs. Printing devices with fixed page-wide array printheads may be well suited for high volume printing because the fixed printhead includes relatively few moving parts, the fixed printhead does not change direction or move during printing, and the image medium may be advanced at a high speed relative to the printhead during the ink application process.

A printing device including a typical fixed page-wide array printhead may, however, be less effective for printing high quality images because image defects and/or artifacts may occur. A print defect may, for example, occur when a nozzle becomes clogged and does not apply ink to the paper below. Defects and artifacts may be caused by inaccuracies, which may include paper advance inaccuracies, misplacement of ink dots, variations between different nozzles, and other inaccuracies. The high prevalence of defects and artifacts in images created with typical fixed page-wide array printheads may, thus, make high quality image printing challenging or impossible.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
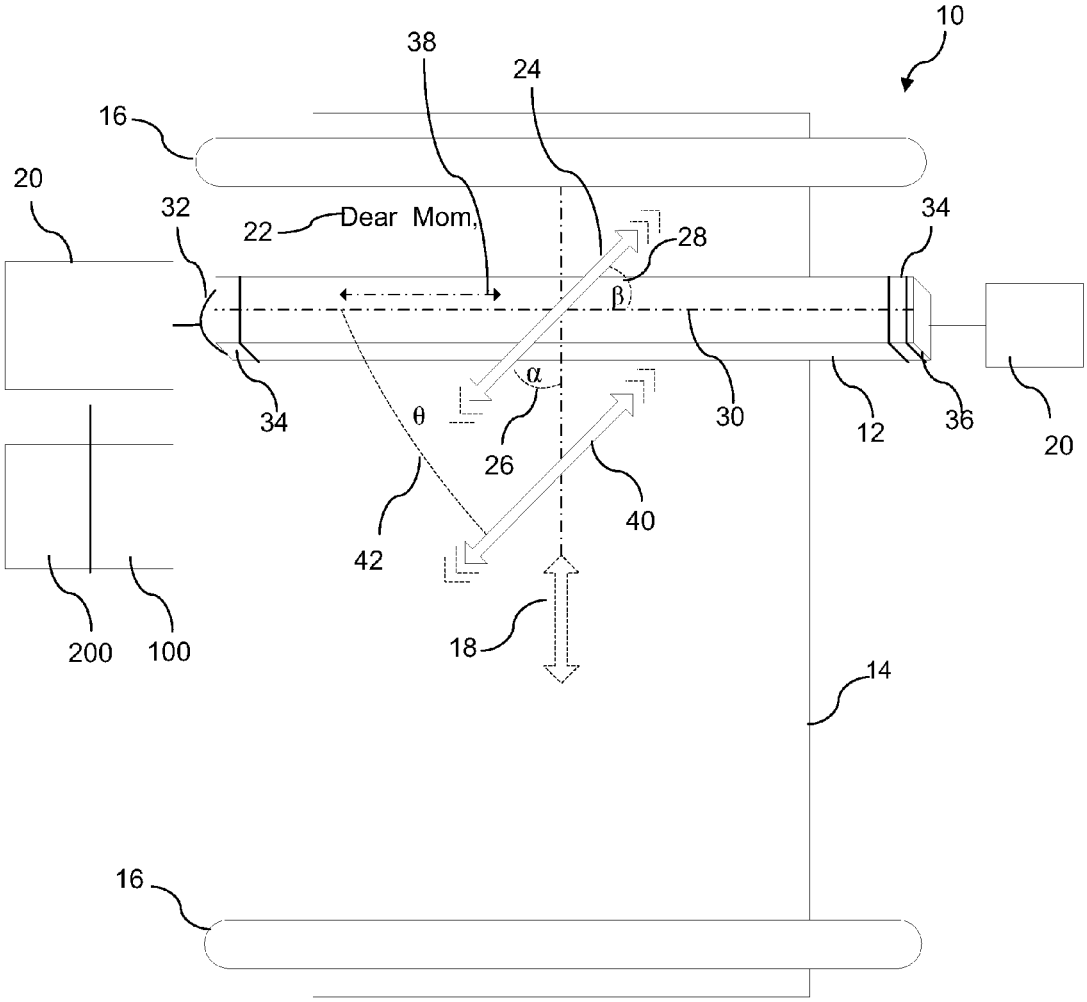
FIG. 1 is a schematic diagram of an image printing device with oscillating printhead according to an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements. Moreover, some of the blocks depicted in the drawings may be combined into a single function.

DETAILED DESCRIPTION

In the following detailed description, numerous specific details are set forth in order to provide a thorough understanding of the invention. It will however be understood by those skilled in the art that the present invention may be practiced without these specific details. In other instances, well-known methods, procedures, and components have not been described in detail so as not to obscure the present invention.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

An image printing device (e.g., a printer, an inkjet printer, a toner based printer, solid ink printer, or other printing device) may include a printhead and/or nozzles that oscillate or otherwise move while applying ink to a print medium (e.g., a piece of paper). An image printing device may, for example, include a printhead with multiple nozzles installed on the printhead to apply ink to an image medium (e.g., a piece of paper). The printhead may, in some embodiments, be roughly rectangular in shape and may be wider than the width or boundaries of the paper expected to be used in a printhead width direction. Multiple nozzles may be associated with or installed in the printhead. Multiple nozzles may, for example, be installed in or be components of one or more dies associated with, affixed to, and/or attached to the printhead. The one or more nozzles and/or dies may be arranged in an array, grid, line or similar pattern on the printhead. The nozzles may drop, eject, spray or otherwise apply ink onto the paper passing under the printhead. The array of nozzles and/or dies may extend beyond the boundary of the paper (when paper of an expected size is used) so that ink may be applied to the entire area of the paper while the printhead moves relative to the paper in the width direction.

An image medium advancing device (e.g., roller) may move and/or advance or move (e.g., using rollers) an image medium under the printhead in a direction perpendicular or normal to the width direction of the printhead. As the image medium moves under the printhead, nozzles may apply ink to the paper. As nozzles apply ink, the printhead may oscillate, translate, vibrate, or otherwise move back and forth along an axis or direction defined by or lying in an angle not normal to the direction the image medium is moving.

Oscillating the printhead and/or nozzles while applying ink may allow each ink nozzle to apply ink to a larger area on the print medium, thereby reducing common printing inaccuracies and defects. Printing inaccuracies and defects may, for example, include clogged nozzles causing missing ink dots in an image, paper advance inaccuracies resulting in banding, left and/or right misplacement of ink dots, die-to-die tolerance inaccuracies (e.g., on printhead with multiple dies) causing ink dot placement errors, misdirected ink dots resulting in misplaced dots, differences in ink drop weight in different nozzles resulting in non-uniform ink dot size and banding (e.g., non-uniform size, color, brightness ink dots), scanning printhead color sequence defects (e.g., banding resulting from left-to-right versus right-to-left printhead movement direction), and other defects. Allowing each nozzle to apply ink to a larger area on the print medium may enable the printing device to hide, cover up, or cure printing inaccuracies and defects by allowing properly functioning nozzles to apply ink to the areas covered by improperly, irregularly, or non-uniformly functioning nozzles. An image printing device with an oscillating or moving printhead may, thus, be particularly useful for high quality printing jobs because high quality printing jobs may require low incidence of inaccuracies and defects. Other or different benefits may be realized by embodiments of the invention.

FIG. 1 is a schematic diagram of an image printing device 10 (e.g., a printer, an inkjet printer, a laser printer, a toner based printer, solid ink printer, or other printing device) with an oscillating or moving printhead according to an embodiment of the present invention. A printhead 12 (e.g., a fixed pagewide array printhead, fixed printhead, scanning printhead, or other printhead) may apply ink 22 (e.g., dye, pigment, powder, toner, solid ink, plastic, or other substance) to an image medium or print medium 14 (e.g., a sheet of paper, synthetic paper, photographic paper, wax paper, metal, metal fabric, glass, polymeric sheets, flexible PVC, self-adhesive vinyl, mesh or other type of image medium). Image medium advancing device 16 (e.g., a roller, set of rollers, conveyer device, track, feeder, or other type of device) may advance, move, progress, translate or otherwise change the location of image medium 14 relative to printhead 12. Image medium advancing device 16 may, for example, advance image medium 14 in one or more directions 18 relative to printhead 12. In some embodiments, image medium movement direction 18 may be perpendicular, substantially perpendicular (e.g., within ±10 degrees (°) or another angle of perpendicular), or oriented at another angle relative to the width of printhead 12, width axis 30, and/or width direction 38 of printhead, and/or another reference line, axis, plane or direction.

Image medium advancing device 16 may, in some embodiments, advance or move image medium 14 in a continuous, smooth, constant, continual, and/or steady motion relative to printhead 12 and/or other components of printing device 10. Image medium advancing device 16 may, in some embodiments, advance image medium 14 in an incremental, step-wise, stuttered, isochronal, periodic, and/or intermittent motion relative to printhead 12 and/or other components of printing device 10. Image medium advancing device 16 may, for example, advance image medium 14 in steps or increments of 1/300 inch and/or another distance. The distance of steps or increments may pre-determined or may be adjusted, monitored, calculated, determined, and/or otherwise controlled by printing device control system 200 and/or other system associated with image printing device 10.

Printing device control system 200, printhead oscillation system 100, and/or another system associated with image printing device 10 may control image medium advancing device 16. Printing device control system 200 may control the direction, speed, and increments at which image medium advancing device 16 moves or advances image medium 14. Printing device control system 200 may, in some embodiments, control other dynamics, features, and/or characteristics of image medium advancing device 16. Printing device control system 200 may, for example, calculate the proper speed at which to advance image medium taking into account the frequency, velocity, position, distance of oscillation, acceleration, and other oscillation dynamics parameters and characteristics of oscillating printhead 12.

According to some embodiments, image medium advancing device 16 may advance image medium 14 at a speed that is less than the speed and/or velocity of printhead 12 travel or oscillation in the direction of image medium movement 18. The velocity of printhead 12 oscillation in the direction of image medium movement 18 may, in some embodiments, be the component (e.g., vector component) of the velocity in the direction of image medium movement 18. Image medium advancing device 16 may, in some embodiments, advance or move image medium 14 at other speeds, velocities, and/or ranges of speeds and velocities. Image medium advancing device 16 may advance image medium 14 at different speeds based on printing requirements, image quality requirements, print job requirements, pixel resolution (e.g., dots per inch (dpi)), spatial resolution (e.g., pixels per inch (ppi)), image resolution, type of image medium, printing quality requirements, print speed, and/or other information or requirements. Image medium advancing device 16 may advance image medium 14, for example, at 35 inches per second or another speed or rate.

Printing device control system 200 may determine one or more oscillation control commands. This may be done based on one or more printing requirements, on pre-set programs, and/or other data. Printing device control system 200 may control printhead 12 by outputting oscillation control commands, signals, data, instructions, control command, or other information to printhead oscillating device 20. Printing device control system 200, in some embodiments, may input printing requirements and/or image data from a computer or other device separate from image printing device 10, from another component of image printing device 10, or from another source. Printing device control system 200 may use the input image data to produce or alter one or more oscillation control commands. Printing device control system 200 may determine or calculate oscillation control commands based upon or taking into account speed at which image medium 14 is advanced and/or other factors. Printing device control system 200 may, in some embodiments, determine different control commands based on the dynamics of printhead oscillation. Printing device control system 200 may, for example, determine oscillation control commands based on the fact that during oscillation the area that each ink nozzle may cover may be defined by two dimensions or axes as opposed to one dimension as with a static printhead. Printing device control system 200 may, in some embodiments, determine oscillation control commands based a two-dimensional area of ink nozzle coverage.

In some embodiments, a printhead oscillation control system 100 may control oscillation of oscillating printhead 12. Printhead oscillation control system 100 may be a component of, be associated with, and/or operate in conjunction with printing device control system 200. Printhead oscillation control system 100 may be separate from, operate separate from, and/or perform functions separate printing device control system 200.

A printhead oscillating device 20 (e.g., a voice coil actuator, motor driven crankshaft with connect rod, a cam (e.g., a spring loaded cam, push-pull cam, and/or other type of cam device), a piezoelectric actuator, piezoelectric motor, motor or other device, or one or more of such devices) may oscillate, dither, vibrate, or otherwise move and/or translate printhead 12. Printhead 12 may, for example, be oscillated while ink 22 is applied to image medium 14. Printhead oscillating device 20 may be a motor driven crank with a connecting rod that drives, translates, and/or moves printhead 12 through oscillation cycles. Printhead 12 may be held in place by a resonant leaf-spring 32 while printhead oscillating device 20 drives printhead 12 through an oscillation path. Printhead 12 may include a counterweight 36 to control, limit, and/or minimize static loads, vibration loads, fatigue, cyclical loads, and other forces applied to printhead 12, nozzles, dies, and other components of image printing device 10. Printhead 12 may be installed in, affixed to, or otherwise attached to a housing 34 to reduce static loads (e.g., shear, bending, torsion and other static loads) vibration loads, cyclical loads, fatigue, and/other damage to printhead 12, nozzles, dies, and/or other components of the image printing device 10. More than one device, motor, etc. may be part of printhead oscillating device 20.

According to some embodiments, printhead 12 may be oscillated in a direction 24 defined by an angle (α) 26 relative to an image medium movement direction 18. Image medium movement direction 18 may be an axis, imaginary line, reference line, or other type of reference feature defining the direction or path of movement of image medium 14. Printhead 12 may, in some embodiments, be oscillated in a direction not normal or orthogonal to direction 18. A direction not normal or not orthogonal to direction 18 may, for example, be any direction 24 defined by an angle (α) 26 other than 90° from direction 18. A direction 24 not normal to direction 18 may be, for example, be a direction not perpendicular to direction 18. A direction 24 not normal to direction 18 may, in some embodiments, be any direction that does not lie in a plane whose normal vector is parallel to direction image medium movement direction 18.

Direction 24 may be fixed. In other embodiments, direction 24 may be adjusted or altered during operation. For example, direction 24 may be adjusted based on the speed at which image medium 14 is advanced with respect to printhead 14. In some embodiments, angle (α) 26 between direction of oscillation 24 and image medium movement direction 18 may be inversely proportional to the speed image medium 14 is advanced. If, for example, image medium 14 is advanced at a higher speed, direction 24 may be defined by a smaller angle (α) 26 from the direction 18 than if image medium 14 were advanced at a lower speed. Angle (α) 26 between direction of oscillation 24 and direction of image medium movement 18 may, in some embodiments be unrelated to speed of image medium 14. Other relationships between angle (α) 26, oscillation direction 24, and image medium movement direction 18 may be used. According to some embodiments angle (α) 26 may be adjusted by printer control system 200 based on printing requirements, image quality requirements, requirements of the print job, pixel resolution (e.g., dots per inch (dpi)), spatial resolution (e.g., pixels per inch (ppi)), image resolution, type of image medium, dot spread requirements, printing quality requirements, print speed, and/or other information or requirements. Angle (α) 26 may, in some embodiments, be equal to 45° or another angle not normal to direction 18.

According to some embodiments, printhead 12 may be oscillated in a direction 24 defined by angle (β) 28 relative to printhead axis 30 (e.g., printhead centerline, reference line, imaginary line, and/or datum). Printhead axis 30 may, in some embodiments, be a centerline or approximate centerline of printhead 12 in a width direction 38 of printhead 12, a line parallel or approximately parallel to a centerline, or another reference line. Width direction 38 may be the longest dimension of the printhead when the printhead is placed on a typical print medium. Angle (β) 28 may, in some embodiments, be any angle not equal to 0° and/or 180° (e.g., oscillation direction 24 may, for example, be not parallel to printhead axis 30).

Angle (β) 28 relative to printhead axis 30 may, in some embodiments, be proportional, calculated based on, related to, or otherwise dependent upon the speed at which image medium 14 is advanced. Angle (β) 28 may be pre-determined during manufacturing and/or be adjustable during use of image printing device. According to some embodiments, angle (β) 28 may be adjusted by printer control system 200 based on printing requirements, image quality requirements, requirements of the print job, pixel resolution (e.g., dpi), spatial resolution (e.g., ppi), image resolution, type of image medium, dot spread requirements, printing quality requirements, print speed and/or other information or requirements.

Printhead 12 may be oscillated by printhead oscillating device 20 at a pre-determined, calculated, or otherwise defined frequency and/or rate. The frequency may be, in some embodiments, a pre-determined frequency, set of frequencies, or range of frequencies defined during manufacturing of image printing device 10. The frequency may, for example, be based on image quality requirements, type of image medium 14 used, speed of printing, quality requirements of print job, ink nozzle clogs, and/or other information, data, or factors. The frequency may be, for example, 250-500 Hertz (Hz), another frequency, or another range of frequencies.

Printhead 12, in some embodiments, may be oscillated or moved by printhead oscillating device 20 according to a pre-determined velocity profile. The velocity profile may, in some embodiments, be a sinusoidal velocity profile in which the velocity of the printhead 12 is equal to the first derivative of the position of the printhead in the oscillation cycle. Printhead velocity in the direction of image medium movement 18 may, in some embodiments, be greater than the speed of image medium advancement or another velocity. Printhead 12 velocity in the direction of image medium movement 18 may, in some embodiments, be the component (e.g., vector component) of the velocity in the direction of image medium movement 18. Printhead 12 velocity in the direction of image medium movement 18 may be faster than the speed of image medium movement so that each nozzle may cover a specified area on image medium 14. Other velocity profiles may be used. According to some embodiments the velocity profile may be adjusted by printer control system 200 based on printing requirements, image quality requirements, requirements of the print job, pixel resolution (e.g., dots per inch (dpi)), spatial resolution (e.g., pixels per inch (ppi)), image resolution, type of image medium, dot spread requirements, printing quality requirements, print speed and/or other information or requirements.

According to some embodiments, printhead 12 may be oscillated or moved by printhead oscillating device 20 over a pre-determined, calculated, or otherwise defined distance.

The distance over which printhead 12 oscillates may be calculated or determined based on printing requirements, image quality requirements, print job requirements, pixel resolution (e.g., dpi), spatial resolution (e.g., ppi), image resolution, type of image medium, printing quality requirements, print speed and/or other information or requirements. Printhead 12 may, for example, based on a pixel resolution of 1200 dpi, oscillate over a distance of 20 nozzle diameters (e.g., ±10 inkjet nozzle diameters), approximately 20 nozzle diameters, a distance of 0.166 (e.g., ±0.083 inches), or any other suitable distance. Printhead 12 may, in some embodiments, oscillate over a range of distances. The range of distances may be determined, controlled, or changed by, for example, printing device control system 200 during printing operation.

Printhead 12 may, according to some embodiments, be oscillated or moved by printhead oscillating device 20 along a pre-determined, calculated, or otherwise defined path. The path may be, for example, linear, elliptical, curved, circular, or another shape. The shape of the path may, for example, be based on image quality requirements, type of image medium 14 used, speed of printing, quality requirements of print job, ink nozzle clogs, and/or other information, data, or factors.

According to some embodiments, printhead 12 may apply ink 22 to image medium 14 uni-directionally during oscillation. Ink 22 may be applied uni-directionally, if printhead 12 only applies ink 22 when moving in one direction (e.g., forward at angle) and not while printhead 12 is moving in the opposite direction (e.g., rearward at angle) or vice versa. In some embodiments, printhead 12 may apply ink 22 to image medium 14 continuously, regularly, at intervals, or according to other patterns throughout an oscillation cycle. Other ink application functions, processes, and/or methods may be used.

In some embodiments, movement of image medium 14 and printhead 12 may be relative, such that moving image medium 14 may substitute or be in addition to moving printhead 12. Image medium 14 may, in some embodiments, be moved or oscillated in a direction 40 defined by angle (θ) 42 relative to printhead axis 30 (e.g., printhead centerline, reference line, imaginary line, and/or datum). Image medium 14 may be moved or oscillated at a frequency, over a distance, according to a velocity, and/or along a path based on image quality requirements, type of image medium used, speed of printing, quality requirements of print job, ink nozzle clogs, and/or other information, data, or factors. Image medium 14 oscillation may be similar to the printhead 12 oscillation as discussed in other embodiments. While image medium 14 is oscillated, printhead 12 may, for example, oscillate along direction 24, oscillate along another direction, remain stationary, and/or otherwise function.

Figure 2:
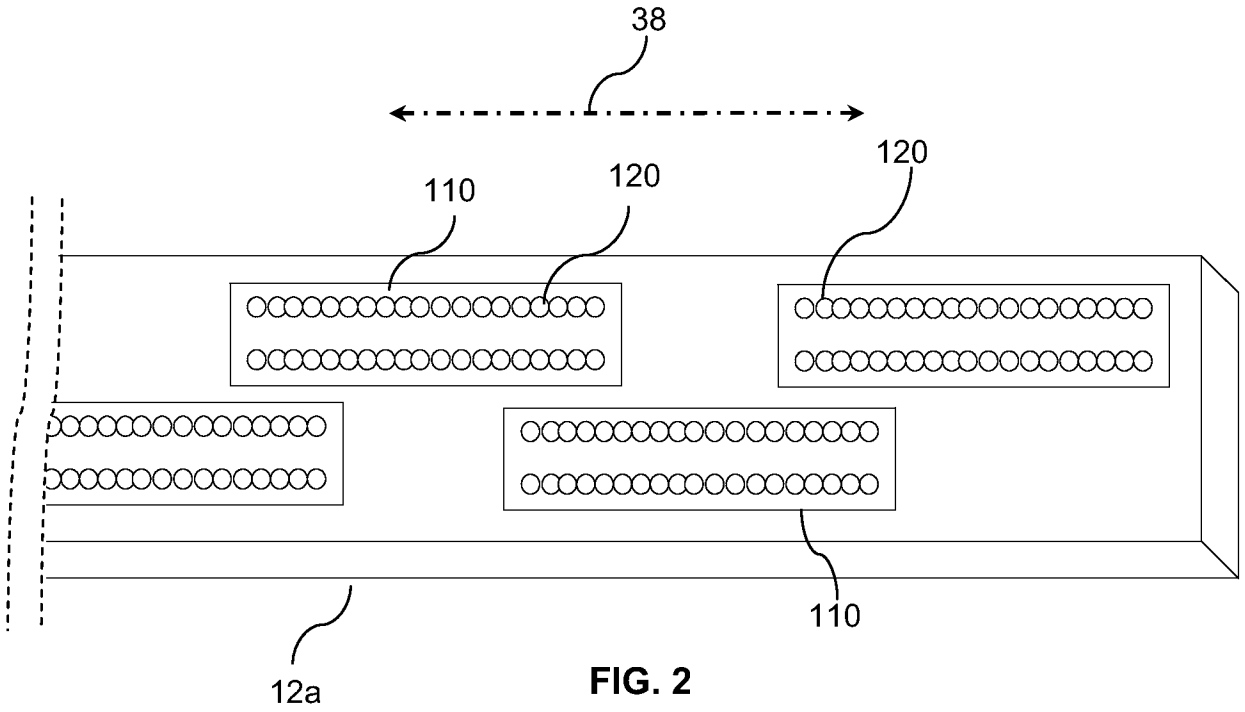
FIG. 2 is a schematic diagram of an oscillating printhead according to an embodiment of the present invention.

FIG. 2 is a schematic diagram of a printhead according to an embodiment of the present invention. A printhead 12*a* may, in some embodiments, include one or more dies 110. Each die 110 may mount, house, control, contain, or otherwise include one or more nozzles 120 (e.g., ink nozzle(s), ink orifice(s), spout, or other ink delivery device). One or more dies 110 may, for example, be fabricated from silicon, ceramics, and/or other metals or materials. In some embodiments, one or more dies 110 may include multiple layers of silicon, ceramics, metals, and other materials. Dies 110 may include logic, power control, measurement, and/or other types of circuits to control ink ejection from the nozzles 120. Each die 110 may, in some embodiments, be staggered in position relative to other dies 110. In some embodiments, printhead 12*a* may include ten dies 110 or another number of dies 110 installed in a staggered configuration on printhead 12*a*, and each die 110 may include 4,224 nozzles 120 or another number of nozzles 120. In some embodiments, printhead 12*a* may include 1,200 nozzles per inch arranged in a line or another number of nozzles per unit length or area. Dies 110 and/or nozzles 120 may, in some embodiments, be arranged on printhead 12*a* such that dies 110 and/or nozzles continuously span the length of printhead 12*a*.

Printhead 12*a*, dies 110, and/or nozzles 120 may, in some embodiments, extend, in printhead width direction 38, beyond the boundaries or edges of the typical image medium 14 used with printer 10 (while a typical printer can support various paper sizes and widths, the typical image medium, when discussed herein, refers to the widest image medium, largest image medium, and/or image medium of largest surface area meant to be used with the printer). Printhead 12*a* may, for example, be wider than image medium 14 and may include dies 110 and/or nozzles 120 installed to be placed beyond and/or outside the width boundaries of image medium 14 when printhead 12*a* is centered along the width of print medium 14. Dies 110 and/or nozzles 120 may be installed outside the width boundaries of image medium 14 so that ink may be applied to the entire area of image medium 14 while printhead 12*a* moves relative to the paper in the width direction.

According to some embodiments, nozzles 120 may be arranged in a line, grid, array, and/or another pattern on die 110. Nozzles 120 may, for example, be arranged in multiple staggered rows on a die 110 such that the pattern of nozzles continuously spans the entire width of image medium 14 and extends beyond the boundaries of image medium 14 when the printhead is moved in a certain range of motion.

Figure 3:
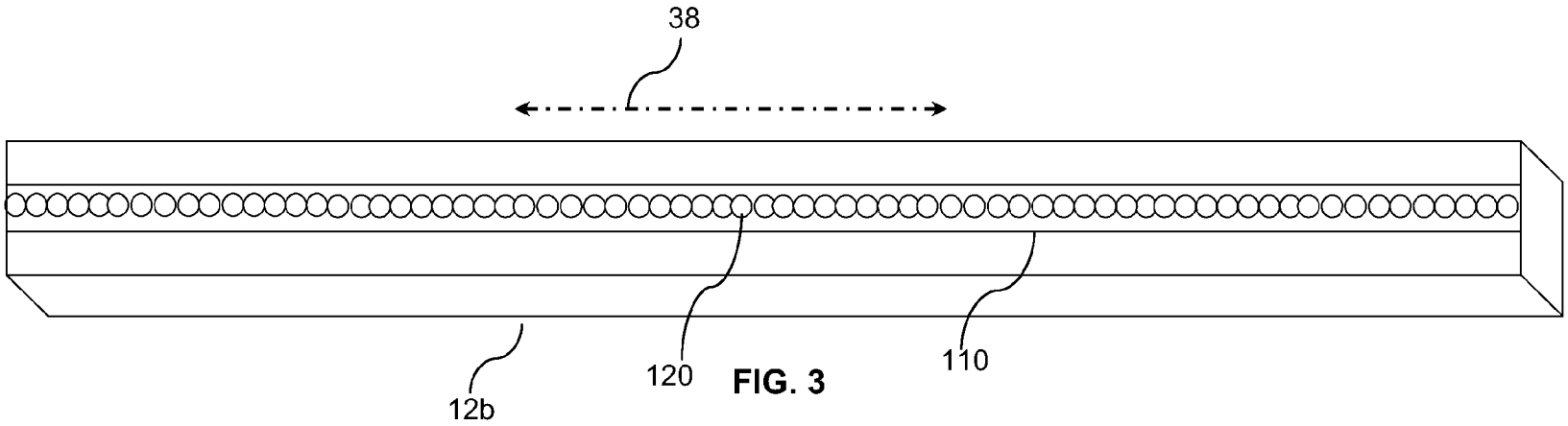
FIG. 3 is a schematic diagram of a printhead with a single row of nozzles according an embodiment of the present invention.

FIG. 3 is a schematic diagram of a printhead with a single row of nozzles according to embodiments of the present invention. A printhead 12*b* may, in some embodiments, include a single die 110 or multiple dies 110. Each die 110 may mount, house, control, contain, or otherwise include one or more nozzles 120 (e.g., ink nozzle(s), ink orifice(s), spout, or other ink delivery device). Printhead 12*b* may, in some embodiments, include multiple nozzles 120 mounted, housed, contained, controlled, or otherwise directly included in printhead 12*b*.

Printhead 12*b*, die(s) 110, and/or nozzles 120 may, in some embodiments, extend, in printhead width direction 38, beyond the boundaries and/or edges of the typical image medium 14 used with printer 10. Dies 110 and/or nozzles 120 may be installed outside the width boundaries of image medium 14 so that ink may be applied to the entire area of image medium 14 while printhead 12*b* moves relative to the paper in the width direction.

According to some embodiments, image printing device 10 with an oscillating or moving printhead 12 may hide printing inaccuracies and defects. Hiding printing inaccuracies and defects may be beneficial in high quality printing because high quality printing may require low incidence of inaccuracies and defects.

Ink application inaccuracies and defects may, for example, be hidden because any given spot on image medium 14 may be printed (e.g., have ink applied to) by two or more nozzles 120 over the time that printhead 12 moves or oscillates. Locations on image medium 14 may, for example, have ink applied by two or more nozzles 120, if printhead oscillates over a distance equal to or larger than the distance between nozzles 120.

According to some embodiments, image printing device 10 may operate in multiple print modes. Each print mode may, for example, define or roughly define how many nozzles 120 may apply ink to each spot on an image medium 14. The print modes may define how many nozzles may apply ink to a given location on image medium 14 based on the speed or rate of image medium 14 advancement. The print modes may, in some embodiments, define angle, frequency, speed, path and/or distance of printhead oscillation.

Figure 4:
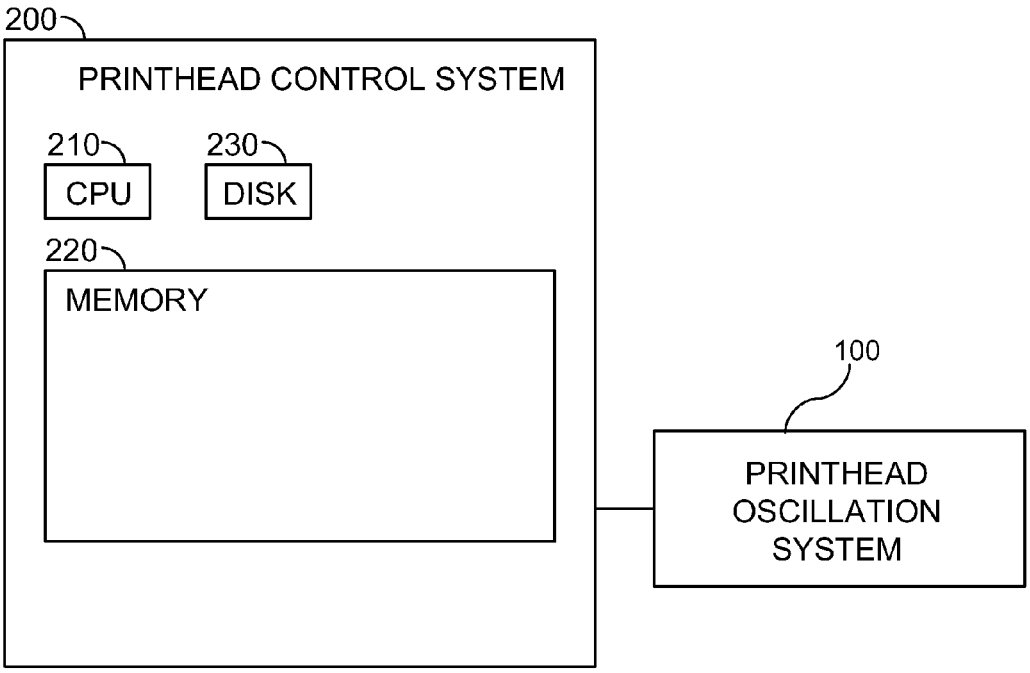
FIG. 4 is a schematic diagram of a printhead control system according to an embodiment of the present invention.

FIG. 4 is a schematic diagram of a printing device control system according to an embodiment of the present invention. Printing device control system 200 may include one or more processor(s) or controller(s) 210, memory 220, and long term storage 230.

Memory 220 and/or long term storage 230 may include, for example, oscillation angle data, oscillation frequency data, oscillation distance data, oscillation direction data, oscillation velocity data, printhead position data, image medium advancement speed data, image medium advance step data, and/or other information or data.

Processor or controller 210 may be, for example, a central processing unit (CPU), a chip or any suitable computing or computational device. Processor or controller 210 may include multiple processors, and may include general-purpose processors and/or dedicated processors. Processor 210 may execute code or instructions, for example, stored in memory 220 or long-term storage 230, to carry out embodiments of the present invention.

Memory 220 may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. Memory 220 may be or may include multiple memory units.

Long term storage 230 may be or may include, for example, a hard disk drive, a floppy disk drive, a Compact Disk (CD) drive, a CD-Recordable (CD-R) drive, a universal serial bus (USB) device or other suitable removable and/or fixed storage unit, and may include multiple or a combination of such units.

Figure 5:
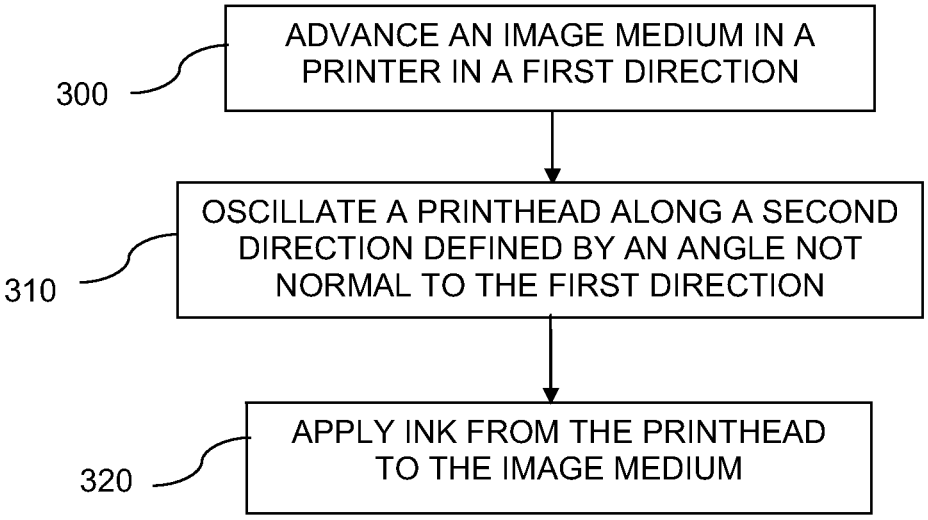
FIG. 5 is a flowchart of a method according to an embodiment of the present invention.

FIG. 5 is a flowchart of a method according to an embodiment of the present invention. In operation 300, an image medium (e.g. image medium 14 in FIG. 1) may be advanced in a printer (e.g., printing device 10 of FIG. 1) in a first direction (e.g. image medium movement direction 18 of FIG. 1). The first direction may be a direction defined by an axis roughly perpendicular to a width direction of the printhead (e.g. printhead 12 of FIG. 1).

In operation 310, a printhead may be moved or oscillated along (e.g., back and forth) a second direction (e.g., printhead oscillation direction 24 of FIG. 1) defined by an angle (e.g. angle ($\alpha$) 26 of FIG. 1) not normal to the first direction. The printhead may be oscillated at a frequency, at a velocity, and over a distance based on printing requirements.

In operation 320, ink (e.g., ink 22 of FIG. 1) may be applied from the printhead to the image medium. Ink may, for example, be applied by multiple ink nozzles (e.g., ink nozzle 120 of FIG. 2). Ink nozzles, in some embodiments, may be associated with multiple dies (e.g., die(s) 110 of FIG. 2). Operations 310 and 320 typically take place at the same time or during overlapping times.

Other or different series of operations may be used.

Different embodiments are disclosed herein. Features of certain embodiments may be combined with features of other embodiments; thus, certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

The invention claimed is:

1. An image printing device, comprising:

an image medium advancing device to advance an image medium in a first direction under a pagewide printhead; and printhead oscillating device to oscillate the pagewide printhead;

wherein the pagewide printhead has a longitudinal axis perpendicular to the first direction across the image medium; and the printhead oscillating device, to maintain the longitudinal axis of the printhead perpendicular to the first direction across the image medium while oscillating the printhead linearly, back-and-forth in a straight line, along a second direction, the second direction at an angle not normal to the first direction; and a plurality of ink nozzles associated with the pagewide printhead to apply ink to the image medium.

2. The image printing device of claim 1, comprising a plurality of dies, each die associated with the pagewide printhead and each die comprising a plurality of the ink nozzles.

3. An image printing device, comprising:

an image medium advancing device to advance an image medium in a first direction under a pagewide printhead;

wherein the pagewide printhead is configured to oscillate, back-and-forth, linearly in a straight line along a second direction, the second direction at an angle not normal to the first direction, the pagewide printhead having a longitudinal axis that remains perpendicular to the first direction during oscillation; and a plurality of ink nozzles associated with the pagewide printhead to apply ink to the image medium.

4. An image printing device as in claim 3, in which the direction of oscillation can be changed between printing pages.

5. An image printing device as in claim 4, in which the direction of oscillation changes within a printing page.

6. An image printing device as in claim 4, in which the oscillation speed varies depending upon a speed of an image medium.

7. An image printing device as in claim 4, in Which adjacent ink nozzles print to points that are linear in the first direction.

8. An image printing device as in claim 3, in which the oscillation of the printhead is linear oscillation.

9. An image printing device as in claim 4, in which the direction of oscillation can be changed between printing pages.

10. An image printing device as in claim 5, in which the direction of oscillation changes within a printing page.

11. An image printing device as in claim 4, in which the oscillation speed varies depending upon a speed of an image medium.

12. An image printing device as in claim 4, in which adjacent ink nozzles print to points that are linear in the first direction.

13. An image printing device as in claim 1, in which the direction of oscillation is changed between printing pages.

14. An image printing device as in claim 13, in which the direction of oscillation is changed within a printing page.

15. An image printing device as in claim 1, in which the oscillation speed varies depending upon a speed of an image medium.

16. An image printing device as in claim 1, in which adjacent ink nozzles print to points that are linear in the first direction.

17. An image printing device as in claim 1, in which the linear oscillation of the printhead changes in at least one of: speed, second direction, and frequency.

18. An image printing device as in claim 1, in which the second direction is at an oblique angle with respect to an axis of the printhead.

19. An image printing device as in claim 1, in which the second direction is adjusted based on a speed at which the image medium is advanced with respect to the printhead.

20. An image printing device, comprising:

an image medium advancing device to advance an image medium in a first direction under a pagewide printhead; and printhead oscillating device to oscillate the pagewide printhead;

wherein the pagewide printhead has a longitudinal axis perpendicular to the first direction across the image medium; and the printhead oscillating device to maintain the longitudinal axis of the printhead perpendicular to the first direction across the image medium while oscillating the printhead linearly, back-and-forth in a straight line, along a second direction, the second direction at an angle not normal to the first direction; and wherein the second direction is adjusted based on a speed at which the image medium is advanced with respect to the image printing device.

21. An image printing device as in claim 1, wherein the second direction varies between successive sheets of image media, the second direction is not parallel to a longest axis of the printhead, an oscillation speed varies depending on a speed of the image medium, a pair of adjacent ink nozzles each produce markings on the image medium that are in line in a direction of travel of the image medium, and the printhead oscillates parallel to a surface of the print medium.

* * * * *